United States Patent [19]

Bengtsson

[11] 4,030,437

[45] June 21, 1977

[54] SHIP'S DOCK

[75] Inventor: Bo Gunnar Bengtsson, Ockero, Sweden

[73] Assignee: Trascandica AG, Basel, Switzerland

[22] Filed: Mar. 25, 1976

[21] Appl. No.: 670,569

[30] Foreign Application Priority Data

Mar. 27, 1975 Sweden ..... 7503600

[52] U.S. Cl. ..... 114/46

[51] Int. Cl.[2] ..... B63C 1/06

[58] Field of Search ..... 114/45, 46, 222, 44, 114/49; 61/64–68

[56] References Cited

UNITED STATES PATENTS

| | | | |
|---|---|---|---|
| 2,287,434 | 6/1942 | Knudsen | 114/45 |
| 2,360,690 | 10/1944 | Koulichkov | 114/45 |
| 2,774,322 | 12/1956 | Harris | 114/46 |
| 3,752,109 | 8/1973 | Seiple | 114/222 |

FOREIGN PATENTS OR APPLICATIONS

| | | | |
|---|---|---|---|
| 1,169,295 | 11/1969 | United Kingdom | 114/45 |

*Primary Examiner*—Trygve M. Blix
*Assistant Examiner*—Stuart M. Goldstein
*Attorney, Agent, or Firm*—Cantor and Singer

[57] ABSTRACT

A floating dock which includes a bottom portion which is about one half of the length of the largest ship to be considered, but substantially narrower than the ship, a short stem portion at one end of the bottom portion, and a U-shaped stabilizing body at the opposite end. The stabilizing body preferably is separate from the bottom portion, whereas the stem portion is integral therewith.

7 Claims, 7 Drawing Figures

SHIP'S DOCK

BACKGROUND OF THE INVENTION

Ship's repair work is, in many cases, concerned only with damage to the bows or to the stern of the vessel. Consequently, in such cases, it is unnecessary to place the entire vessel in dry dock. No suitable docks, however, have been proposed in which the damaged part of the vessel can be housed in a floating dock for repair work, whilst the remainder of the vessel remains afloat. Different, so-called semi-docks have been proposed in which sealing means are arranged to seal against the ship's hull so as to obtain a working area which can be pumped dry. Such docks are expensive in relation to their size and it is difficult to produce an effective seal.

SUMMARY OF THE INVENTION

The present invention therefore relates to a dock which enables external repair work to be carried out, even on very large vessels, which is relatively inexpensive and which is so constructed that it can readily be transported to a ship in need of repair, which ship may lie against the quayside or at some temporary mooring, instead of it being necessary to tow the ship to the dock.

The dock according to the invention is characterized by the fact that it comprises a bottom potion which has a plurality of displacement tanks and which is of substantially rectangular configuration, said portion having a length corresponding approximately to half the length of the largest ship which might be conceived to require the use of said dock, and a width which is smaller than the width of said ship; a stem portion having displacement and stabilizing tanks and extending over a minor portion of the length of the bottom portion; and an U-shaped stabilizing body arranged adjacent the end of the bottom portion opposite the stem portion, said stabilizing body having a width which is greater than the width of said bottom portion.

In accordance with a further development of the invention, the stabilizing body can be formed as a working device which can be used separately from the dock.

DESCRIPTION OF A PREFERRED EMBODIMENT

To obtain the requisite lateral stability, a conventional dock comprises a bottom portion and side walls. In the case of the present invention, a substantial portion of the ship shall remain afloat, and hence the tank spaces which ensure stability as the ship enters and leaves the dock can be made relatively small.

A dock constructed in accordance with the invention comprises the bottom portion 10, a stem portion 11 and a stabilising body 12. Although not necessary, the stabilising body 12 may be a device which is separate from the bottom portion.

Figure 1:
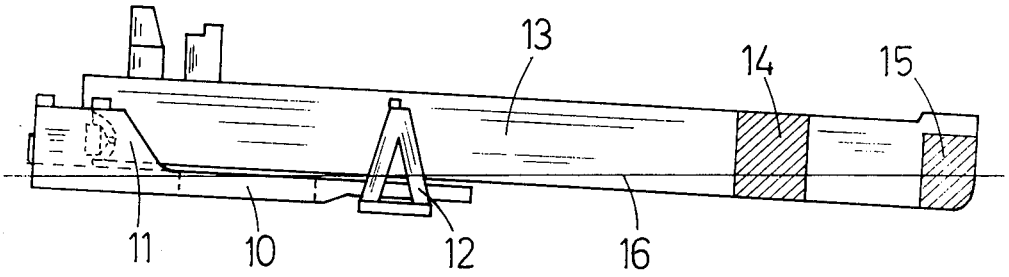
FIG. 1 is a side view of a dock in working position whilst work is being carried out on a large vessel.
Figure 2:
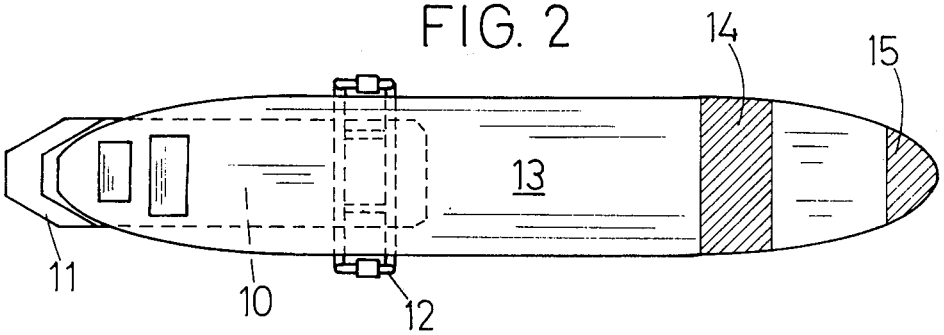
FIG. 2 is a top plan view of the embodiment of FIG. 1.

FIGS. 1 and 2 show the dock in working position, work being carried out on a ship 13 within the region of the ship's propeller and rudder. The dock is provided with displacement tanks 10*a*, and its lifting capacity is selected with respect to the largest ship considered, and the length of the bottom portion 10 will be approximately half the length of the ship. By trimming the ship with the use of ballast in the forward tanks 14, 15, the intention is to force the forward portion of the ship down so that the dock, so to speak, merely assists in lifting the stern of the vessel.

In FIG. 1, the water line is referenced 16, and it will be apparent from the Figure that the area of the ship around the rudder and propeller is held above the water line. The dock obtains a sufficiently great lifting force, despite the fact that its width is smaller than the width of the ship.

Figure 4:
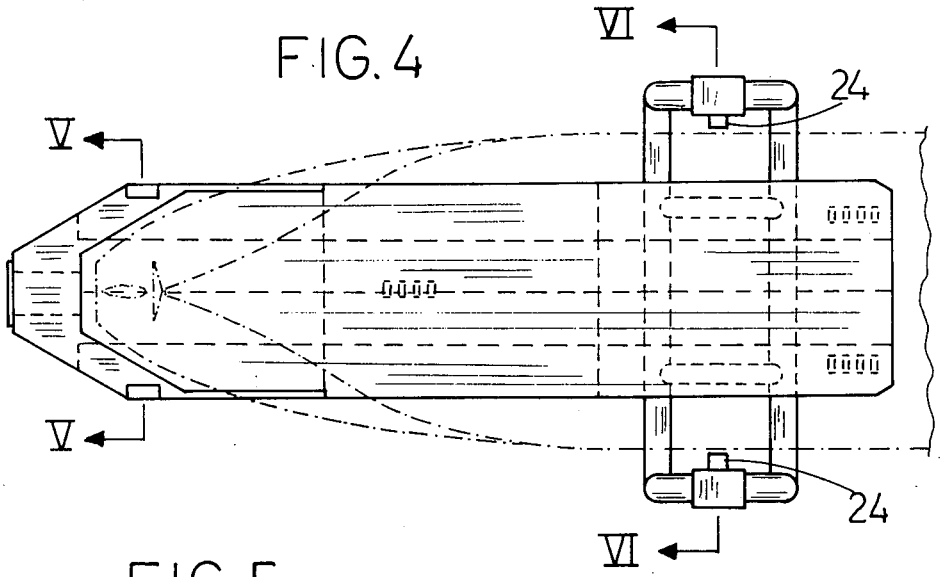
FIG. 4 is a corresponding top plan view.
Figure 5:
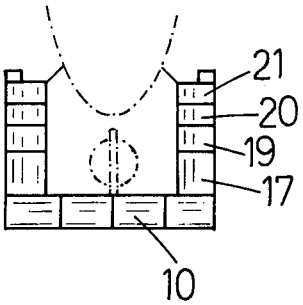
FIG. 5 is a sectional view taken along the line V—V in FIG. 4.
Figure 6:
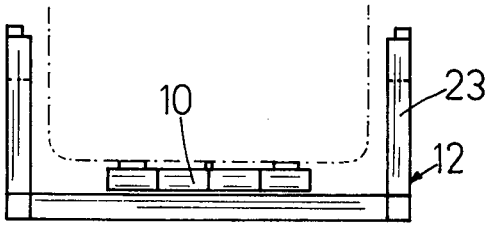
FIG. 6 is a sectional view taken along the line VI—VI in FIG. 4.

As will be seen from FIGS. 2 and 4, the stem portion 11 is formed so as to facilitate towing of the dock. Arranged within the stem portion are the displacement tanks 17 stabilising tanks 11*a*, auxiliary machine room 18, a storage space 19, a workshop 20, and office and crew space 21. The stem portion is also provided with a so-called bow propeller arranged in a transverse tunnel 22, by means of which propeller the dock is guided during a docking manoeuvre. As will readily be perceived, the propeller arranged in the tunnel 22, described above, may be replaced with a propeller having a 360° working range which can then be used also to move the dock. In the stem portion there is a port with a ramp so that direct connection is obtained with the deck of the bottom portion during a working operation.

The stabilising body 12 comprises tubular tanks of, in principle, U-shaped construction. The underwater body of the stabilising body forms a framework of displacement tanks 12*a* , the width of which is selected to accommodate the width of the ship and will thus be substantially wider than the bottom portion 10 of the dock. With the illustrated embodiment, the stabilising body 12 is separate from the dock. The side pieces of the stabilising body 12 comprise vertically extending stabilising tanks 23 which are inclined towards each other, so as to substantially form an A-shaped configuration.

Since the stabilising body 12 is separate from the dock, the stabilising body can be secured to the bottom of the dock when the dock is being towed over long distances. The stabilising body is provided with two drive propellers having a 360° working range. By means of the drive propellers 24 and the bow propeller in the tunnel shown at 22, the dock can be effectively guided to the correct position, whilst the stabilising body can be moved separately from the dock by means of the bow propeller 22. The stabilising body is conveniently provided with its own pump machinery. When afloat the dock has a very short water line in relation to its displacement and is therefore only slightly influenced by sea movement. Docking can be safety effected with wave heights in the region of 2 metres.

With a dock of the type described, it is possible to effect external repair work on tankers which are not completely gas-free. The ship may also contain considerable quantities of dirty ballast water or bilge, if this can be used to trim the forward tanks.

Since the stabilising body is separate from the dock, subsequent to docking the ship, the stabilising body can be used as a working device along the forward half of the ship. The side pieces can be provided with suitable platforms so that external surfaces of the ship above the water level can be painted.

Figure 7:
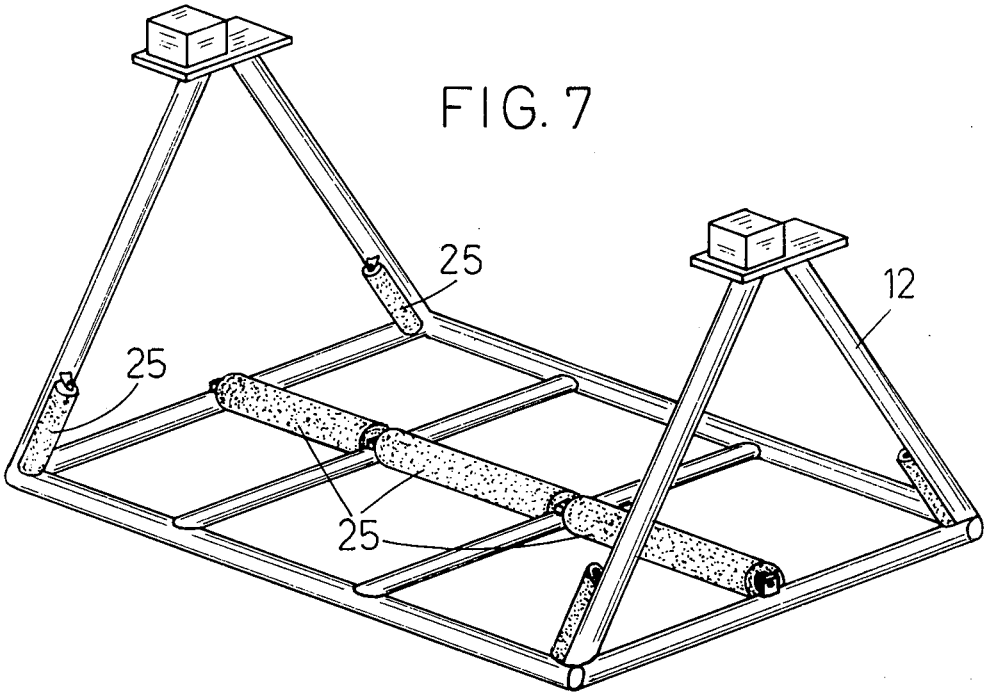
FIG. 7 illustrates diagrammatically equipment for use when the stabilizing body is used as a working device.
Figure 3:
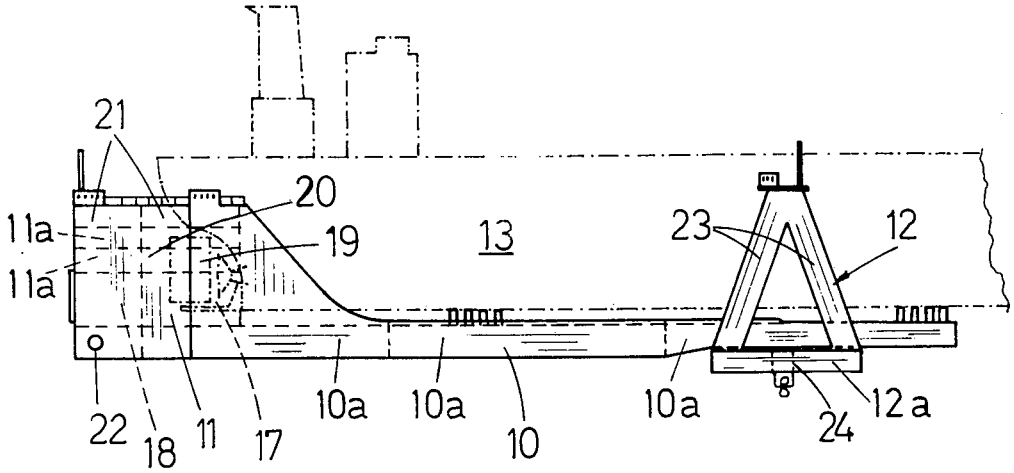
FIG. 3 shows in larger scale the portion around the dock in FIG. 1.

As diagrammatically illustrated in FIG. 7, the underwater body and the lower portions of the side piece can be provided with rotatable brushes 25 or scraping means by means of which the undersurface of the ship can be scraped free of barnacles and other matter. As will readily be understood, the dock according to the invention can also be constructed so that frogmen can inspect the bottom of the ship and carry out minor adjustment work.

Subsequent to moving the vessel out of the dock, the stabilising body can be used in a similar manner to carry out work on the stern portion of the vessel. The dock can also be used for conventional dry-docking of small ships the length of which is approximately the same as the length of the bottom portion of the dock.

What I claim is:

1. A ship's dock arranged to enable work to be carried out on a limited portion of a large ship having a hull defined by conventional length and breadth proportions, said dock being capable of raising said limited portion from the water in cooperation with the ballast tanks in said ship and comprising:

a. an elongate plane bottom portion provided with displacement tanks and having a length corresponding to about one half the length of said hull and a width substantially smaller than the breadth of said hull;

b. a stem portion having displacement and stabilizing tanks, located at one end of said bottom portion, raising above the level thereof and extending over a minor portion of the length of said bottom portion;

c. a separate U-shaped stabilizing body arranged at the end portion of said bottom portion remote from said stem portion, said body having an internal width greater than the breadth of said hull; said body adapted to be removeably secured to said bottom portion.

2. The ship's dock according to claim 1, in which the stabilizing body comprises a framework of horizontal displacement tanks, and two side pieces, each of which comprises at least one substantially vertically oriented stabilizing tank.

3. The ship's dock according to claim 2, in which each side piece comprises two tanks arranged at an angle to each other to form a substantially A-shaped configuration.

4. The ship's dock according to claim 1 in which the stabilizing body is provided with its own propulsion machinery.

5. The ship's dock according to claim 1 in which the bottom portion, adjacent the stem portion is provided with propulsion means.

6. The ship's dock according to claim 1 in which the stabilizing body at the lower portion thereof is provided with means for cleaning the bottom of a ship.

7. The ship's dock according to claim 1, wherein said U-shaped stabilizing body raises above the level of said bottom portion and extends over a minor portion of the length of said bottom portion.

* * * * *